United States Patent [19]

Blum et al.

[11] 4,412,837

[45] Nov. 1, 1983

[54] PROCESS FOR RESIST PRINTING CELLULOSE FIBRES WITH REACTIVE OR DEVELOPING DYES

[75] Inventors: Adolf Blum; Hans D. Opitz, both of Ludwigshafen, Fed. Rep. of Germany

[73] Assignee: BASF Aktiengesellschaft, Ludwigshafen, Fed. Rep. of Germany

[21] Appl. No.: 373,409

[22] Filed: Apr. 30, 1982

[30] Foreign Application Priority Data

May 8, 1981 [DE] Fed. Rep. of Germany ..... 3118193

[51] Int. Cl.[3] ..... C09D 11/02; D06P 5/12

[52] U.S. Cl. ..... 8/449; 8/455; 8/531; 8/532; 8/611; 8/666; 8/918

[58] Field of Search ..... 8/449, 455, 611, 466

[56] References Cited

U.S. PATENT DOCUMENTS

| | | | |
|---|---|---|---|
| 3,700,402 | 10/1972 | Noda et al. | 8/449 |
| 3,706,525 | 12/1972 | Blackwell et al. | 8/480 |
| 4,265,629 | 5/1981 | Ribka et al. | 8/449 |
| 4,278,433 | 7/1981 | Blum et al. | 8/449 |
| 4,322,213 | 3/1982 | Tappe et al. | 8/449 |

OTHER PUBLICATIONS

Research Disclosure, Oct. 1980, vol. 198, pp. 415–416, No. 19827.

*Primary Examiner*—A. Lionel Clingman
*Attorney, Agent, or Firm*—Bernhard R. Swick

[57] ABSTRACT

Process for imprinting textiles made from cellulose fibers or cellulose fibers mixed with other fibers employing reactive and/or developing dyes according to the etch-resist process using printing dyes which contain per 1000 parts by weight, 10 to 100 parts by weight of one or more of the following compounds: butyl glycol, butyl diglycol, butyl triglycol, 1,2-butane diol, 2,5-hexane diol, and diethylene glycol monoethylether. This results in essentially complete penetration.

11 Claims, No Drawings

PROCESS FOR RESIST PRINTING CELLULOSE FIBRES WITH REACTIVE OR DEVELOPING DYES

BACKGROUND OF THE INVENTION

1. Field of the Invention

This invention relates to printing on textiles made from cellulose fibers or mixtures of cellulose fibers with other fibers. More specifically the invention relates to printing on such textile materials with reactive and/or developing dyes according to the etch-resist process.

2. Description of the Prior Art

German application No. 23 26 522 describes a process for resist effects with reactive dyes under reactive dyes on textile surfaces of native or regenerated cellulose fiber materials. In accordance with this familiar process, sulfites, thiosulfates or thioureas are applied to the textile materials as resist agents. Alkalies are employed as setting agents and a class of reactive dyes are employed which react with the resist agent and which contain as the reactive group the β-sulfatoethylsulfonic- or sulfatoethylsulfonamide group as well as another class of reactive dyes which do not react with the resist agent during setting. The resist agent is applied to the textile material by preprinting or overprinting. The dyes are set by steam or hot air treatment.

If resist printing pastes are used which contain reactive dyes such as monochlorotriazine types as well as the additives such as alkali, thickeners, oxidants, urea and the resist agent necessary for the direct printing process, one notices that the stability of such resist printing pastes is very limited and is a function of the respective monochlorotriazine dye. As a result thereof, one observes a continuing reduction of the color depth as a function of the shelf life of the resist printing paste, that is, the result is insufficiently reproducible color depth of the resist effects.

German application No. 16 19 606 describes a resist printing process according to which alkali hydroxymethane sulfonate is used as a resist agent or a substance which forms alkali hydroxymethane sulfonate under the conditions of the application. Because of an insufficient storage stability of the resist printing pastes, one obtains varying color yields during printing dependent upon the shelf life of the printing pastes.

German Pat. No. 29 16 673 describes the use of reaction products of bisulfite adducts of aldehydes or ketones with 2 to 6 carbon atoms and ammonia, or primary or secondary amines in a mole ratio of 3:1 to 1:1 as resist agent for processes for the manufacture of resist prints under reactive dyes on textile materials consisting of cellulose fibers or which contain these as a mixture with other fibers. Stable resist printing pastes are obtained which permit high color yields of the multicolored resist dyestuffs and a flawless resist of the background dyestuffs even after prolonged storage.

However, none of the above-referenced processes result in a satisfactory penetration of the print, that is, on the back side of the imprinted textiles, the printed pattern appears to be washed out and does not have the same color strength as on the front side.

SUMMARY OF THE INVENTION

The purpose of this invention is the development of a process for printing on textiles made from cellulose fibers or cellulose fibers mixed with other fibers employing reactive and/or developing dyes in accordance with the etch-resist process which result in as complete a penetration of the print as possible.

According to this invention, this requirement is met by adding 10 to 100 parts by weight of a compound selected from the group consisting of butylglycol,
butyldiglycol,
butyltriglycol,
1,2-butane diol
2,5-hexane diol
diethylene glycol monoethylether and mixtures thereof to 1000 parts by weight of the printing paste.

DETAILED DESCRIPTION OF THE INVENTION

Textiles should be understood to be primarily fabrics, knitted goods and non-wovens. These materials preferably consist either of cotton or regenerated cellulose or of mixtures of these two fibers. However, mixtures of cellulose fibers and synthetic fibers such as polyester and polyamide may also be used. In such cases, the dyestuffs commonly used for dyeing synthetic fibers are used such as dispersion dyes for polyester fibers.

Suitable reactive dyes are incorporated, for instance, in the color index. Possible resist reactive dyes, that is, reactive dyes which react with the resist agent include those containing a β-sulfatoethylsulfonic, a β-sulfatoethylsulfonamide or a vinyl sulfonic grouping. Reactive dyes which do not react with the resist agent, that is, which are not resistant and which are, therefore, contained in the resist printing paste may contain the following reactive groups: monochlorotriazine, dichlorotriazine, dichloropyrimidine, trichloropyrimidine, dichloropyridazine and chloroaminotriazine groups. Suitable dyestuffs of this type are commercially available.

Developing dyestuffs are developed directly on the textile material by initially treating the textile goods with anilides of oxynaphthoic acid and by reaction with stable diazonium salts as coupling components in a later process step.

Resist prints may be obtained according to a number of process variations. It is possible, for instance, to initially apply a pattern to a textile fabric by way of a resist printing paste which contains the resist agent and a reactive dye which does not react with the resist agent. Possibly after an intermediate drying process, a printing paste is applied to the entire surface of the thus imprinted material. In addition to commonly used components of printing pastes, this printing paste contains a reactive dye which reacts with the resist agent. The background of the material is dyed with this last printing paste. This printing paste may be applied either by imprinting the entire surface or by padding with the aid of a foulard. According to the invention, an essentially complete penetration of the print is achieved if the printing paste used for the last described process which is applied over the entire surface contains in addition to commonly used printing paste components a reactive dye which reacts with the resist agent. This resist agent contains 10 to 100 parts by weight of one or more of the following: butylglycol (2-butoxyethanol), butyldiglycol (2-(2-butoxyethoxy)ethanol), butyltriglycol (2-[2-(2-butoxyethoxy)ethoxy]ethanol), 1,2-butane diol, 2,5-hexane diol, and diethylene glycol monoethylether per 1000 parts by weight of the printing paste. The printing paste for the background dyeing and/or the padding liquor containing dischargeable dyestuffs preferably contains 50 to 80 grams per kilogram of one of the above-referenced compounds or a mixture thereof.

If the referenced alcohol derivatives are added in a quantity of 50 to 100, preferably 60 to 80 grams per kilogram, of the resist printing paste, flow effects are obtained. Flow effects in which the patterned print shows tendencies to flow are familiar, for instance, from the batik printing. Thus the process according to this invention facilitates production of an essentially 100 percent penetrating print and also the manufacture of a print which shows flow tendencies if the selected alcohol derivates are added to the resist printing paste.

In a process variation of the etch-resist method, one may also proceed in such a manner that the textile goods are totally imprinted with a printing paste which contains the etchable background dye and, for instance, butyl diglycol and/or by padding a padding liquor onto the material which contains the etchable dyestuff and butyl diglycol and then imprinting the material with the resist printing paste after an intermediate drying step. If flow effects are desired, the resist printing paste may contain butyl diglycol or one or more of the suitable alcohol derivates. The resist printing paste may be applied by commonly used equipment, for instance, by means of a print roller or also in accordance with the spray printing process.

The above-referenced process variations are also very well suited for manufacturing white resist by imprinting a resist printing paste which does not contain any dyestuffs in accordance with the pattern.

A background coloration with a particularly good penetration when the textile material is imprinted with a printing paste which contains as a significant component at least one etchable reactive dye and, as penetration agent, butyl glycol, butyl diglycol, 2,5-hexane diol and/or butyl triglycol and if the resist printing paste is subsequently printed on to the material in accordance with the pattern without an intermediate drying period, in this case the resist printing paste does not contain a penetration agent. However, if flow effects are to be produced, butyl glycol, butyl diglycol, butyl triglycol and/or 1,2-butane diol are added to the resist printing paste. In this case the resist printing paste will contain 50 to 100 parts by weight of butyl glycol, butyl diglycol, butyl triglycol and/or 1,2-butane diol per 1000 parts by weight. The background can also be dyed by way of padding. In order to achieve good penetration, the padding liquor will then contain butyl glycol, butyl diglycol, 2,5-hexane diol and/or butyl triglycol as well as a dischargeable reactive dye.

The textile material can also be impregnated with a liquor or printing paste which contains a component of a developing dye instead of a reactive dye. The completely impregnated material is then imprinted in accordance with a pattern using a resist printing paste which contains 50 to 100 parts by weight of butyl diglycol per 1000 parts by weight of the printing paste and a resist agent and is then completely imprinted with a diazo component of the developing dye without intermediate drying. This process is followed by setting of the dyes.

Another possible variation of the process according to this invention consists of initially applying the alcohol derivatives such as butyl diglycol to the entire surface of the textiles which is followed by dyeing the background and subsequent application of the resist printing paste according to the pattern or to initially apply the resist printing pastes in accordance with the pattern and to then dye the background after an intermediate drying period. If these process variations are employed, none of the printing pastes will contain the penetration agent to be used in accordance with this invention.

Possible resist agents include all of the reduction agents commonly used for the etch-resist process such as sulfites, thiosulfates, thioureas, methane- or ethanesulfonate group containing reduction agents and thiourea dioxide.

Particularly stable resist printing pastes are obtained if reaction products of bisulfite adducts of ketones or aldehydes having 2 to 6 carbon atoms and ammonia, or primary or secondary amines in a mole ratio of 3:1 to 1:1 are used as resist agents. Such compounds are described in German Pat. No. 29 16 673. Primarily used as resist agents are the reaction products of bisulfite adducts of acetaldehyde and ammonia in mole ratios of 3:1 to 1:1 with the best effects being obtained with the sodium or potassium salt of 1,1',1''-nitrilotriethane sulfonic acid. The resist agents are used in quantities of 1 to 100 grams per kilogram of the printing paste.

Because of the electrolyte sensitivity of synthetic thickeners, the viscosity of the resist printing paste is primarily adjusted by adding natural thickeners. Suitable natural thickeners include meal ether, starch ether, tragacanth and alginates. However, it is also possible to adjust the viscosity with the aid of synthetic thickeners. Because of the electrolyte content of the resist printing pastes, however, greater quantities of the synthetic thickeners are required. Mixtures of natural and synthetic thickeners may also be used. Suitable synthetic thickeners include homo- or copolymers of ethylenically unsaturated carboxylic acids with 3 to 5 carbon atoms primarily polymers of acrylic acid, methacrylic acid, maleic acid and maleic anhydride as well as mixtures of the copolymers of the referenced carboxylic acids. The copolymers of the referenced carboxylic acids may contain up to 60 percent by weight of other ethylenically unsaturated compounds such as acrylates, styrene, ethylene, vinyl ether or amides of ethylenically unsaturated $C_3$- to $C_5$- carboxylic acids in polymerized form. Preferably the acid content of the copolymers varies between 75 and 99 percent by weight. Particularly high molecular polymers which are very effective thickeners are obtained when the referenced ethylenically unsaturated carboxylic acids as well as the also above-referenced ethylenically unsaturated monomers which are possibly copolymerizable with the carboxylic acids are polymerized together with comonomers containing 2 or more ethylenically unsaturated double bonds. Examples for such comonomers include divinyl benzene, butane diol diacrylate, glycol diacrylate, divinyl dioxane and divinyl ether and ester of pentaerythritol and sorbitol. These comonomers represent approximately 0.05 to 10 percent of the structure of the copolymers.

The thickening effect of the synthetic thickeners occurs if the polymers are partially or completely neutralized with bases. 1000 parts by weight of the printing paste contains 30 to 500 parts by weight of a natural thickener. The synthetic thickeners are used in quantities of 5 to 20 parts by weight per 1000 parts by weight of the printing paste. As a rule, the viscosity of the resist printing paste lies between 20 and 50 Pas. As a rule, the printing paste for the background dyeing has a viscosity of 15 to 40 Pas.

The printing pastes may contain the state of the art auxiliaries such as setting agents, foam inhibitors, urea and alkali donors, that is, agents which liberate alkali during the setting process such as sodium or potassium bicarbonate or the sodium salt of trichloroacetic acid. The printing paste for the background generally contains 50 to 250 parts by weight of urea per 1000 parts by weight of the printing paste. The resist printing paste also may contain urea, for instance, in an amount of 50 to 250 parts by weight per 1000 parts by weight of the printing paste. The parts listed in the examples are parts by weight, the data in percent are based upon the weight of the material.

EXAMPLE 1

A cotton fabric having a weight of 100 grams/m$^2$ and pretreated in an alkaline solution is imprinted with a pattern using a printing paste which has the following composition:

| | |
|---|---|
| 30 parts | of yellow C.I. reaction dye No. 13,245 |
| 600 parts | of a 10 percent aqueous alginate thickener |
| 250 parts | urea |
| 10 parts | m-nitroethane sulfonic sodium |
| 20 parts | soda |
| 30 parts | 1,1',1''-nitrilotriethane sulfonic potassium |
| 60 parts | water |
| 1000 parts | |

This was followed by a wet-on-wet overprint for dyeing the background using a printing paste with the following composition:

| | |
|---|---|
| 60 parts | of the dischargeable blue C.I. reactive dye No. 61,200 |
| 600 parts | of a 10 percent aqueous alginate thickener |
| 200 parts | urea |
| 70 parts | butyl diglycol |
| 10 parts | m-nitroethane sulfonic sodium |
| 60 parts | water |
| 1000 parts | |

The imprinted goods are dried and are subsequently developed by steaming. The steaming process may also be replaced by hot air setting or by wet treatment with alkali (shock setting). In this manner a yellow color on blue background is obtained wherein the imprinted patterns and the imprinted background penetrate 100 percent.

The same results are obtained if the butylglycol in the printing paste for the background dye is replaced by an equal amount of butyldiglycol, 2,5-hexane diol or a mixture of equal parts of butyl glycol and butyl triglycol.

EXAMPLE 2

A cotton knit ready for printing and having a weight of 120 grams/m$^2$ was padded on a foulard using a liquor with the following components per 1000 parts:

80 parts as the dischargeable blue C.I. reactive dye No. 61,200
50 parts urea
250 parts water
50 parts of a 10 percent aqueous alginate thickener
10 parts sodium salt of m-nitrobenzene sulfonic acid
80 parts sodium salt of trichloroacetic acid
480 parts water The padded material was dried at 100° C. and was subsequently imprinted in accordance with the pattern using a resist printing paste which contained the following substances per 1000 parts:

| | |
|---|---|
| 30 parts | of yellow C.I. reactive dye No. 13,245 |
| 5 parts | of a commercially available complex builder |
| 10 parts | sodium salt of m-nitrobenzene sulfonic acid |
| 200 parts | urea |
| 20 parts | soda |
| 600 parts | of a 10 percent aqueous alginate thickener |
| 30 parts | 1,1',1''-nitrilo triethane sulfonic sodium |
| 80 parts | butyl glycol |
| 25 parts | water |
| 1000 parts | |

The textile material was then dried at 130° C. and was steamed at 102° C. for 8 minutes. This resulted in a yellow print upon blue background with the print having clear flowing effects and good penetration.

Comparable effects are obtained when the butyl diglycol is replaced by the same amount of butyl triglycol in the resist printing paste. Corresponding amounts of butyl glycol and 1,2-butane diol resulted in somewhat poorer flowing effects.

EXAMPLE 3

A mercerized cotton fabric having a weight of 180 grams/m$^2$ was padded on a foulard with a liquor which contained the following substances per 1000 parts:

12 parts 2,3-oxynaphthoic acid-anilide
20 parts paraffin oil and
22.5 parts sodium hydroxide solution 34° Bé

The cotton fabric impregnated in this manner was then imprinted in a pattern with a flow printing paste having the following composition (data in grams/kilogram of printing paste):

| | |
|---|---|
| 70 parts | butyl diglycol |
| 30 parts | nonreservable yellow C.I. reaction dye No. 13,245 |
| 90 parts | potassium salt of 1,1',1''-nitrilo triethane sulfonic acid |
| 100 parts | urea |
| 10 parts | m-nitrobenzene sulfonic sodium |
| 40 parts | soda |
| 660 parts | of 10 percent aqueous alginate thickener |
| 1000 parts | |

This was followed without intermediate drying (wet-in-wet) by an overprint using a printing paste containing the following substances per 1000 parts:

| | |
|---|---|
| 60 parts | diazotized α-amino-anthraquinone |
| 10 parts | 50 percent aqueous acetic acid |
| 1 part | 2,2'-dinaphthylmethane-6,6'-disulfonic sodium |
| 929 parts | 30 percent aqueous cellulose ether thickener |

-continued

| | |
|---|---|
| 1000 parts | |

The cotton fabric overprinted in this manner was dried at 120° C. and was then developed in accordance with the alkali shock process. For this purpose the cotton fabric was impregnated for 15 seconds in a liquor heated to 98° C. and having the following composition:

| | |
|---|---|
| 100 parts | sodium chloride |
| 150 parts | soda |
| 50 parts | potash |
| 50 parts | sodium hydroxide solution 38° Be |
| 650 parts | water |
| 1000 parts | |

This resulted in a yellow coloration on a red background. The background as well as the pattern showed a 100 percent penetration. The patterns showed definite flow effects.

Equally pronounced flow effects were obtained when an equal amount of butyl triglycol was incorporated in the flow printing paste instead of the butyl diglycol.

The dyes on the printed fabric can also be developed by steaming the fabric at a temperature of 102° C. for 3 minutes.

EXAMPLE 4

A cotton fabric having a weight of 150 grams/m$^2$ is imprinted in accordance with the pattern using a colorless etch material with the following composition:

| | |
|---|---|
| 150 parts | sodium salt of hydroxymethane sulfonic acid |
| 150 parts | titanium dioxide |
| 600 parts | British gum thickener |
| 100 parts | water |
| 1000 parts | |

This was followed by a wet-in-wet overprint for dyeing the background using a printing paste with the following composition:

| | |
|---|---|
| 70 parts | of C.I. reactive dye No. 21 200 |
| 600 parts | 10 percent aqueous alginate thickener |
| 10 parts | sodium salt of m-nitrobenzene sulfonic acid |
| 30 parts | sodium bicarbonate |
| 80 parts | butyl diglycol |
| 150 parts | urea |
| 60 parts | water |
| 1000 parts | |

The imprinted fabric was dried at 120° C. and was subsequently developed by steaming at 102° C. for 10 minutes. The goods were then rinsed, oxidized, soaped and rinsed again. A discharge white print was obtained on a blue background. In this case also the fabric was 100 percent penetrated by the blue day.

EXAMPLE 5

A cotton fabric weighing 150 grams/m$^2$ is printed in accordance with a pattern using a color discharge dye with the following composition:

| | |
|---|---|
| 70 parts | yellow C.I. substantive dye No. 68 420 |
| 150 parts | sodium salt of hydroxymethane sulfonic acid |
| 600 parts | British gum thickener |
| 280 parts | water |
| 1000 parts | |

This was followed by a wet-in-wet overprint for the background dye using a printing paste with the following composition:

| | |
|---|---|
| 70 parts | blue C.I. reactive dye No. 21 200 |
| 600 parts | 10 percent aqueous alginate thickener |
| 10 parts | sodium salt of m-nitrobenzene sulfonic acid |
| 30 parts | sodium bicarbonate |
| 80 parts | butyl diglycol |
| 150 parts | urea |
| 60 parts | water |
| 1000 parts | |

The imprinted goods were dried at 120° C. and subsequently developed by steaming at 102° C. for 10 minutes. The fabric was then rinsed, oxidized, soaped and rinsed again. The result was a yellow discharge on a blue background and the material was 100 percent penetrated by the blue dyestuff.

The embodiments of the invention in which an exclusive privilege or property is claimed are defined as follows:

1. In the process for printing textiles made from cellulose fibers or cellulose fibers mixed with other fibers employing reactive and/or developing dyes according to the resist process the improvement wherein 1000 parts by weight of the printing paste contains 10 to 100 parts by weight of a compound selected from the group consisting of:

butylglycol,
butyldiglycol,
butyltriglycol,
1,2-butane diol,
2,5-hexane diol,
diethylene glycol monoethyl ether, and mixtures thereof.

2. Process according to claim 1 wherein the background dying process is carried out with a printing paste containing at least one reactive dye and a compound selected from the group consisting of butyl glycol, butyl diglycol, 2,5-hexane diol, butyl triglycol and mixtures thereof and that the resist printing paste is subsequently imprinted according to the pattern without intermediate drying.

3. Process according to claims 1 and 2 wherein reaction products of bisulfite adducts of ketones or aldehydes having 2 to 6 carbon atoms and ammonia, or primary or secondary amines in a mole ratio of 3:1 to 1:1 are used as resist agents.

4. Process according to claims 1 to 3 wherein the resist printing paste contains a compound selected from the group consisting of butyl glycol, butyl diglycol, butyl triglycol, 1,2-butane diol and mixtures thereof.

5. Process according to claims 1 to 4 wherein the printing paste for the background dying contains butyl diglycol and the resist printing paste contains the sodium or potassium salt of 1,1',1''-nitrilotriethanesulfonic acid as resist agent.

6. Process according to claim 1 wherein a background which is printed with reactive dyes is imprinted with a resist printing paste which contains 50 to 100 parts by weight of a compound selected from the group consisting of butyl glycol, butyl diglycol, butyl triglycol, 1,2-butane diol and mixtures thereof per 1000 parts by weight.

7. Process according to claim 6 wherein a background which is printed with reactive dyes is imprinted with a resist printing paste which contains 50 to 100 parts by weight of butyl diglycol per 1000 parts by weight and as a resist agent, the sodium or potassium salt of 1,1′,1″-nitrilotriethane sulfonic acid.

8. Process according to claims 1 to 3 wherein the printing paste for the background dying contains at least one reactive dye and 10 to 100 parts by weight of butyl diglycol per 1000 parts by weight of the printing paste.

9. Process according to claims 1 to 3 wherein the textile material is completely impregnated with a liquor or printing paste containing a component of a developing dye and that patterns are then imprinted upon the textile materials with a resist printing paste containing 50 to 100 parts of butyl diglycol and the sodium or potassium salt of 1,1′,1″-nitrilotriethanesulfonic acid per 1000 parts by weight of the printing paste, that the textile material is then completely imprinted with the diazo component of the developing dye without intermediate drying and that the dyes are subsequently fixed.

10. Process according to claims 1 to 9 wherein the resist printing paste contains 50 to 250 parts by weight of urea per 1000 parts by weight.

11. Process according to claims 1 to 10 wherein the printing paste for the background dying contains 50 to 250 parts by weight of urea per 1000 parts by weight of the printing paste.

* * * * *